US006323597B1

(12) United States Patent
Janning

(10) Patent No.: US 6,323,597 B1
(45) Date of Patent: Nov. 27, 2001

(54) THERMISTOR SHUNT FOR SERIES WIRED LIGHT STRING

(75) Inventor: John Louis Janning, Dayton, OH (US)

(73) Assignee: JLJ, Inc., Dayton, OH (US)

( * ) Notice: Subject to any disclaimer, the term of this patent is extended or adjusted under 35 U.S.C. 154(b) by 0 days.

(21) Appl. No.: 09/612,885

(22) Filed: Jul. 10, 2000

Related U.S. Application Data

(60) Provisional application No. 60/204,178, filed on May 15, 2000.

(51) Int. Cl.[7] ..... H05B 37/00

(52) U.S. Cl. ..... 315/185 S; 315/123; 315/185 R

(58) Field of Search ..... 315/185 S, 185 R, 315/75, 122, 323, 123, 125; 307/10.8, 100, 157; H05B 37/00

(56) References Cited

U.S. PATENT DOCUMENTS 1,024,495 * 4/1912 Booth ..... 315/122
1,510,847 * 10/1924 Holler ..... 315/185 S
1,641,564 * 9/1927 Zierdt ..... 337/15
1,950,028 * 3/1934 Gustin ..... 176/24
2,072,337 * 3/1937 Kamm ..... 171/97
2,258,646 * 10/1941 Grisdale ..... 201/76
2,461,962 * 2/1949 Carlson ..... 315/92
2,484,596 * 10/1949 Waltz ..... 201/49
2,760,120 * 8/1956 Fisherman ..... 315/186
2,870,377 * 1/1959 Ovrevik ..... 315/92
3,345,482 * 10/1967 Lou ..... 200/118
3,968,398 * 7/1976 Lehmann et al. ..... 315/185 S
4,223,248 * 9/1980 Tong ..... 315/185 S
5,722,632 * 3/1998 Radar et al. ..... 251/129.15
5,852,348 * 12/1998 Lin ..... 315/185 R
6,157,139 * 12/2000 Gibboney, Jr. ..... 315/185 S

* cited by examiner

*Primary Examiner*—Don Wong
*Assistant Examiner*—Trinh Vo Dinh
(74) *Attorney, Agent, or Firm*—Priest & Goldstein, PLLC

(57) ABSTRACT

Use of NTC (Negative Temperature Coefficient) thermistor devices having base electrical resistances in the range of about 400 to 2200 ohms is disclosed. A string set of series-connected, low voltage incandescent lamps can be configured in which each of the lamp filaments in the set is provided with a shunt circuit that includes one of the temperature sensitive NTC thermistor devices which operates as a filament shunt. The thermistor devices may have relatively low conductivity when connected to a source of operating potential during normal operation of the string set. The devices, however, may become fully conductive in response to an increase in the voltage that exceeds the device's normal voltage drop. Remaining lamps in the string can continue to receive nearly rated current and nearly rated voltage and further continue to be illuminated at nearly the same illumination even though other lamps in the string are inoperative due to burning out, being loose in their sockets or being missing from their respective sockets all together. It is desirable for the NTC thermistor devices to use at most, a base resistance that would allow initial operation at or near the point of maximum power dissipation by the device upon failure of its shunted lamp. It is also desirable that the base resistances be high enough to limit "leakage" current so there is no more than a 5% increase in string current compared to the same string without shunts.

20 Claims, 2 Drawing Sheets

THERMISTOR SHUNT FOR SERIES WIRED LIGHT STRING

CROSS-REFERENCE TO RELATED APPLICATION

This application claims the benefit of U.S. Provisional Application Serial No. 60/204,178, filed May 15, 2000.

FIELD OF THE INVENTION

This invention relates to electric lights, such as incandescent lamps wired in series or in series string arrays. More particularly, it relates to shunt circuits and devices that allow a light string to continue to operate upon failure of one or more lamps in the string, due, for example, to one or more faulty lamps, one or more unstable socket connections, or one or more lamps physically fallen from their respective sockets.

BACKGROUND OF THE INVENTION

Advantages of connecting electric lights in series as compared with having all parallel connections are well known. The reasons include less interconnection wiring required, and ability to use lower voltage lamps. The lower voltage lamps can have lower cost, higher efficiency and longer life than parallel-connected lamps normally rated at the higher voltage of the power supply.

One of the most common uses of series light strings, for example, is for decoration and display purposes, particularly during Christmas and other holidays, such as for the decoration of Christmas trees and the like. One popular light set type currently available on the U.S. market comprises one or more strings of fifty miniature lamps (mini-lights) each, with each lamp typically having an operating voltage rating of approximately 2.4 volts, and whose filaments are connected in an electrical series circuit arrangement. If sets of more than fifty lamps are desired, the common practice is to provide a plurality of fifty miniature lamp strings, with the lamps in each string connected in electrical series, and with the plurality of strings being connected in a parallel circuit arrangement. Thus the sum of the voltage drops across lamps in each fifty-lamp series string would generally be on the order of 120 volts supplied by a common AC outlet.

If low voltage Christmas mini-lights were connected in parallel, total string current would be significant and connection wire size could limit flexibility. A transformer may have to be used to lower the voltage, since the normal full line voltage could not appear across such mini-lights due to their low voltage ratings and the small spacing between electrodes. A set of 100 parallel-connected lights would also require the wiring to be capable of handling 20 amperes if used with 200 milliampere rated bulbs. Connecting multiple strings 'end-to-end' as is now customarily done would require 100 amperes if five such strings of 200 milliampere rated bulbs were connected end-to-end.

Series light connections thus have advantages over parallel light connections, particularly for connecting larger strings of low voltage lamps to be operated by common household and business AC outlet power supplies. However, a recognized drawback to series light connections is that when a single lamp fails to illuminate for any reason, there is an open circuit and remaining lamps will fail to light. Locating and replacing defective lamps in series light strings can be very frustrating and time consuming, particularly if multiple lamps are out. In larger strings especially, many lamps may have to be checked before finding a lamp that has failed. The problem is even more compounded when lamps fail for reasons that are not readily apparent visually, such as when series lamps have faulty socket connections.

Accordingly, various proposals have been made aimed at providing different shunt circuits that continue the operation of a series light string in the event one or more lamps fail. One type of shunt circuit uses an element of NTC (Negative Temperature Coefficient) electrical resistance material connected in parallel across each series lamp. When a shunted lamp operates normally, resistance through the NTC element is high. If the lamp fails, an increased current through the NTC element results in the element having a lowered resistance, in turn restoring current to a normal operating level through the light string.

Examples of proposed NTC element shunts being disclosed are found in U.S. Pat. No. 2,484,596 (specifying that the resistance across the NTC element is "effectively an open circuit" for the condition of an operating lamp, and referring to U.S. Pat. No. 2,258,646 as disclosing "suitable material" for the NTC element. In U.S. Pat. No. 2,258,646, the disclosed materials are metal oxides having specific resistances of on the order of 10,000 ohms and higher); U.S. Pat. No. 1,950,028 (specifying compressed metallic powder and sodium silicate to form an "insulative ring or spacer," to be used in place of a "usual glass ring"); U.S. Pat. No. 1,941,984 (specifying a metallic powder and sodium silicate material for fabricating NTC shunt elements); and U.S. Pat. No. 1,641,564 (specifying a metallic powder and sodium silicate material through which the "current flow in the circuit is substantially zero" at the moment of a failing lamp).

With shunt circuits of the NTC type, maintenance is simple because faulty lamps are visible from being the only ones out. Another potential advantage is that if the current through a series light string can be maintained at normal operating levels after failure of a lamp, remaining lamps can continue operating at their same level of brightness, as opposed to operating more brightly which could cause them to prematurely fail.

However, the proposed higher resistance NTC shunt materials have a number of disadvantages, particularly in the context of present day low voltage light strings. For one thing, their response times are low for transitioning to lower, lamp-like resistance levels, especially when starting from particularly lower temperatures, such as outdoors on a cold winter day. For example, the response time for even a typical 3000-ohm NTC thermistor could be on the order of tens of seconds at such temperatures, for the device to transition from higher to lower order resistances upon failure of a lamp. A reason for this is the very low current level at which high resistance NTC devices would initially operate. Another reason is that such lower order resistances would typically not be achieved until toward the very end of the device's temperature transition cycle period.

A further issue is the steady state resistance though the shunt when a lamp has failed. Ideally this resistance should be the same or slightly more than that of a normally operating lamp, in order to maintain current at normal operating levels in a series light string after a lamp has failed. However, the higher resistance NTC devices will typically not transition to low enough resistances to be feasible for use with today's low voltage, 2.4–3.5 volt mini-light lamps in series light strings when operating within acceptable (e.g., UL approved) temperature limits. Still another uncovered problem area is electrical stability of the parts; 3000-ohm and higher NTC thermistors have been observed to frequently fail when used as shunts in 2.4–3.5 volt mini-light lamps in series light strings, due to power or temperature overload. An explanation for this is the higher temperatures required for sufficiently low resistance transitioning, power dissipation maximizing at higher temperatures for an extended period, and the lower current ratings generally for higher impedance NTC thermistor devices.

In spite of prior art disclosures of NTC devices used as shunts in series light strings, the apparent absence of such devices in the marketplace demonstrates a need for alternative commercially feasible low cost shunt circuits that can reliably continue designed operation of series light strings when one or more lamps have failed. Indeed, in the case of low voltage Christmas mini-lights in the U.S., a common commercial expedient is the use of internal bulb shunts that provide short circuit paths when lamps burn out and do not reliably function. Internal bulb shunts also do not function when a lamp has a poor or loose connection in its socket, or if it falls out of its socket; in that case every lamp in the sting goes out and the faulty lamps can be difficult to find. Important considerations for series light shunts are cost and ease of manufacturing of components, size and packaging of components, ability to meet design point specifications, such as for low voltage lamp applications, and also competent performance under anticipated conditions of operation, such as outdoor or cold weather uses. In the event a lamp fails, whether it is because the lamp burns out or has a bad connection with its socket or falls out of its socket, it is desired that the series light string continue operating with remaining lamps continuing to operate at normal or only slightly diminished levels of brightness, which is not the case with internal bulb shunts.

Separately, it is known to place NTC thermistor devices in series with incandescent lamps in order to prevent damage from current surges that can result when lamps are first turned on. An NTC (Negative Temperature Coefficient) thermistor is a device having impedance that varies significantly in inverse proportion to the temperature of the device. In operation, a thermistor's temperature increases due to "self-heating" as current is passed through the device. The thermistors temperature is generally due primarily or at least in part to the ambient operating temperature and current flowing through the thermistor. When placed in series with a lamp, an NTC thermistor would have high impedance reducing the voltage across the lamp when the lamp is turned on. As current flows, the thermistor's impedance generally drops to a lower level, gradually increasing the voltage across the lamp to a normal full operating voltage.

SUMMARY OF THE INVENTION

To provide a shunting circuit for an electric lamp, the lamp and a temperature sensitive NTC thermistor device are connected in parallel. For this purpose, the zero-power resistance of the device should be about 400–2200 ohms at 25° C. (room temperature) for use with 2.4–3.5 volt mini-lights in standard series light strings. In this context, zero-power resistance refers to the dc resistance value of a thermistor at a specified temperature operating with negligible electrical power. It is desirable to use at most, a base resistance that would allow initial operation at or near the point of maximum power dissipation by the device upon failure of its shunted lamp. It is also desirable that the base resistances be high enough to limit "leakage" current so there is no more than a 5% increase in string current compared to the same string without shunts.

For shunting series 2.4-volt mini-lights in a 50 bulb, 120 VAC string, an NTC thermistor with a base resistance (zero-power resistance at 25° C.) of about 500 ohms, or 500 ohms plus or minus 20%, is presently preferred. For shunting series 3.5-volt mini-lights in a 35 bulb, 120 VAC string, an NTC thermistor with a base resistance of about 750 ohms, or 750 ohms plus or minus 20%, is preferred. When used as shunts, the NTC thermistors have reduced steady state resistances after a failure of the lamp has occurred (due, for example, to the lamp being faulty, an unstable socket connection, or the lamp having fallen from its socket, or the like). Base resistance and resistance ratio characteristics should preferably be selected so that when a lamp fails, the NTC device will transition to a steady state resistance that is the same as or preferably slightly greater than the normal operating resistance of the lamp. This will avoid runaway current conditions and allow remaining lamps to continue operating at their original or only slightly degraded levels of brightness. When a lamp fails, current through a series light string is preferably decreased slightly, or is at least maintained or not allowed to increase, so that operating life of the remaining lamps is not diminished. Lower failure mode shunt resistances may be used, with the result that remaining lamps may burn brighter than normal but with reduced operating life and efficiency.

DETAILED DESCRIPTION OF PRESENTLY PREFERRED EMBODIMENTS

Figure 1:
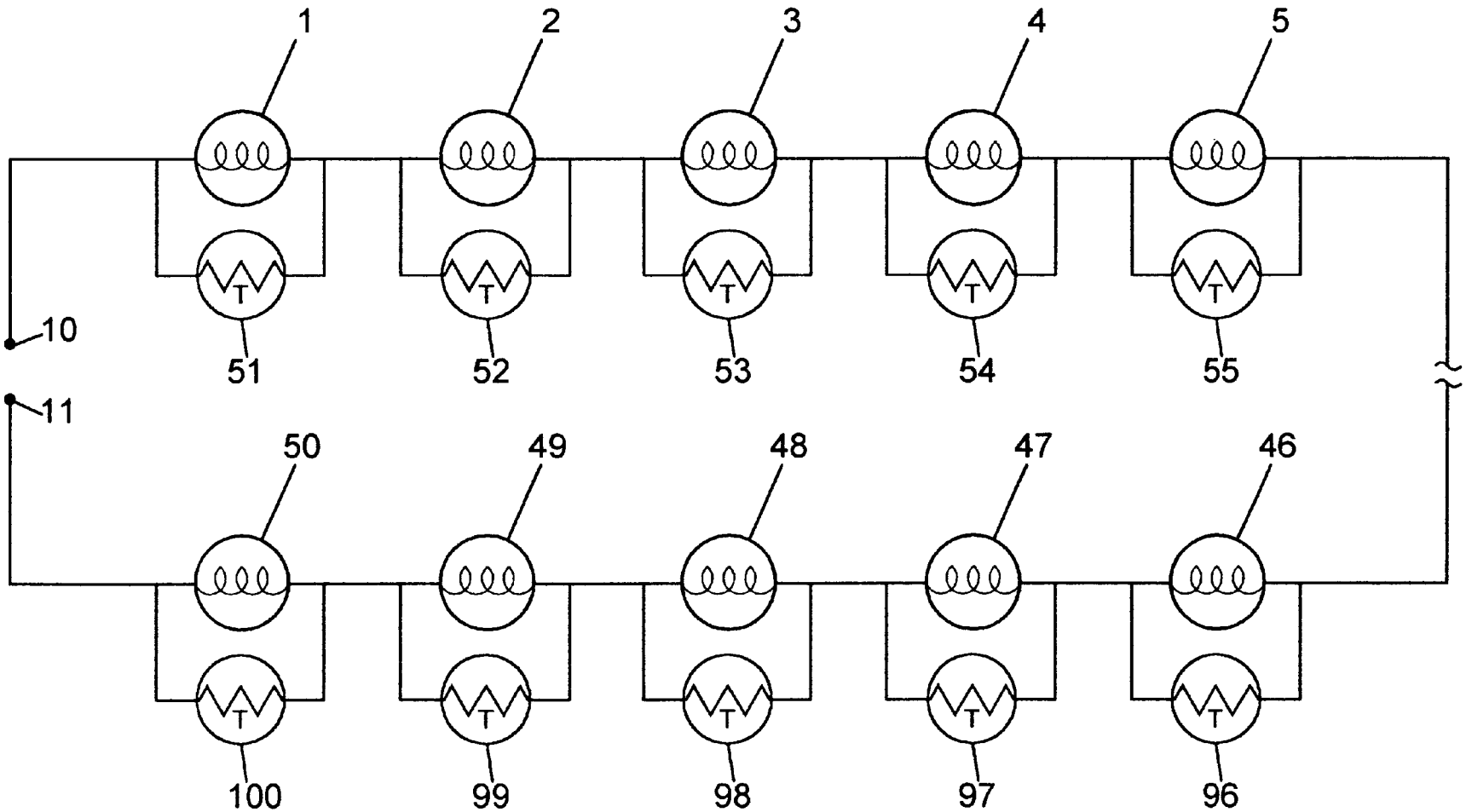
FIG. 1 is an electrical schematic diagram of a series light string circuit using NTC thermistors as shunts.

A new type lighting system may be fabricated in which Christmas tree type mini-lights are connected in electrical series and each shunted by an NTC thermistor device. Such a thermistor device would preferably have an electrical resistance value of hundreds of ohms at room temperature and much lower resistance as the thermistor is heated up. In a shunt for series wired lights, a negative temperature coefficient of resistance (NTC) device is desired. When such an NTC thermistor is electrically connected across each of the lamps socket terminals in a series wired string of lights, a small amount of current will flow through the shunt when the string is operating normally. However, when a lamp becomes inoperative, either because of its burning out, falling from its socket or being placed in the socket crooked, the rest of the string can continue to operate.

When a shunted lamp becomes inoperative for any reason, the voltage increases across the inoperative lamp's thermistor, causing the thermistor's electrical resistance to begin to decrease. This is because a thermistor's electrical resistance is a function of the thermistor's temperature. When a shunted lamp becomes inoperative for any reason, a substantial part of the full power supply line voltage (e.g., 120 VAC) can appear at the terminals of the thermistor at the instant of the lamp failing. For example, if the beginning resistance of the thermistor was 480 ohms, and there were 49 other lamps functioning normally in the series string with a resistance of 12 ohms each, the voltage across the thermistor would be roughly 45% of the power supply line voltage.

Thus, when failure occurs in a shunted lamp, current would start to flow through the thermistor, warming it, and lowering its electrical resistance, providing the thermistor is a negative resistance thermistor (NTC) device. As the resistance is lowered, a point can be reached where a steady state condition exists and no further heating or lowering of resistance occurs. At this point, if properly selected, the desired resistance of the thermistor is substantially equal to or preferably slightly greater than the shunted lamp's electrical resistance when operating properly. This steady state condition is seen as a result of the remaining series lamps in the string acting as a current limiter.

In accordance with this invention, a filament shunting circuit can thus incorporate thermistors for use in connection with a series connected string of incandescent lamps. A series string of incandescent lamps can be provided in which some or all of the lamps each have a negative resistance (NTC) type thermistor as a shunting device connected in parallel across the lamp. Preferably, when the shunt is at room temperature and the lamp is operating normally, the NTC thermistors each have a predetermined resistance value at least twenty times but less than one hundred eighty times greater than the filament resistance for their associated shunted lamp when operating normally. It is desirable to use at most, a base resistance that would allow initial operation at or near the point of maximum power dissipation by the device upon failure of its shunted lamp. It is also desirable that the base resistances be high enough to limit "leakage" current so there is no more than a 5% increase in string current compared to the same string without shunts.

When a shunted lamp becomes inoperative for any reason in the series string, the associated thermistor shunt becomes increasingly warmer and conductive. Preferably, the thermistor is designed to attain a new higher steady state temperature at which the thermistor's electrical resistance is equal to or slightly greater than the normal filament resistance for the associated shunted lamp. As described, the preferred circuit arrangement provides for the continued flow of near rated current through the remaining lamps in the string, together with nearly the same illumination in light output from any of those remaining lamps operative in the string even though a number of lamps in the string are simultaneously inoperative.

An object of the invention is to provide a simple and inexpensive thermal type filament shunt, or bypass, that can be used for each of a plurality of series connected lights or incandescent lamps. Preferably, a filament shunt comprises an NTC thermistor having a predetermined conductive operating value where the electrical resistance value is at least twenty times greater than the normal electrical resistance value of the associated shunted lamp in the string when operating normally. A preferred shunt becomes much more conductive when thermally activated, which would occur for any of the reasons previously stated, and provides continued and uninterrupted flow of nearly rated current through each of the remaining lamps in the string, together with nearly unchanged illumination in individual light output even though multiple lights in the string are out.

It is another object of the invention to provide an improved series-connected light string which has the desirable features set forth above, and yet is of simple and economical construction, is relatively inexpensive to manufacture in mass quantities, thereby keeping the overall cost of the final product on the marketplace at a minimum.

It is also an object of the invention to provide an improved series-connected light string that does not necessitate any type of lamp specially designed to provide a short circuit whenever it burns out, as the case with strings presently on the market.

With reference to the schematic diagram in FIG. 1, a light string constructed in accordance with the presently preferred embodiment of the invention is shown. The illustrated series light string comprises input terminals 10 and 11 adapted to be connected to a suitable source of supply of 110/120 volts of alternating current normally is found in a typical U.S. household or business. Terminal 10 is connected to the first terminal of the first light socket having a lamp (or bulb) 1 operatively plugged therein. The adjacent terminal of the first socket is shown electrically connected to the adjacent terminal of the second socket having a second lamp 2 operatively plugged therein, and so on, so that each of the lamps in the entire string are operatively connected in an electrical series circuit between input terminals 10 and 11. Operatively connected in electrical parallel across the electrical terminals of the first light socket, hence the electrical terminals of first lamp 1, is a first heat sensitive thermistor device 51 which is symbolically illustrated and which effectively functions as a first shunting device in the manner previously described. Likewise, operatively connected in electrical parallel across the electrical terminals of the second socket, hence the second lamp 2, is a second heat sensitive thermistor device 52 which likewise effectively functions as a filament shunt device, and so on, so that each of the remaining sockets, and hence each of remaining lamps 3 through 50 of the series has a corresponding thermistor shunt device 53 through 100 operatively connected in parallel across the lamp.

For practical purposes, it is presently preferred that all thermistor shunt devices 51 through 100 be of identical construction and ideally would have a characteristic, such that, at room temperature, the thermistor shunt devices each have a predetermined high resistance value which is at least twenty times the resistance of their associated shunted lamp when operating normally. The thermistor shunt devices preferably become significantly more conductive when activated, such that the value of the resulting steady state impedance of a thermistor shunt device would be equal to or slightly greater than that of its associated shunted lamp when operating normally.

The mode of operation of the embodiment of FIG. 1 is as follows:

Assuming the light string contains 50 lamps connected in electrical series, and with each lamp having a voltage rating of approximately 2.4 volts RMS, the effective voltage rating for the entire string would be determined by multiplying 50 times 2.4 volts, which resultant product equals 120 volts RMS. By electrically connecting a thermistor type device having a resistance preferably of at least twenty times that of the lamp filament when operating, across each of the lamps shown in FIG. 1, if a lamp becomes inoperative for any reason, the rest of the lamps in the string will continue to operate regardless of whether multiple lamps bum out, or are loose, inserted crooked or missing with respect to their respective sockets. This is because the thermistor device will be activated and may change its electrical resistance to closely match that of the defective lamp's operating resistance and take over in continuing the current through the series wired string of lights. The lamps in the remaining and unaffected sockets in the string can thus stay lit no matter what happens to other lamps in the string. Basically, each lamp functions in effect as if the lamps were connected in parallel. Since the lamps are connected in series, many lamps can be out without causing the remaining lamps in the string to be out. The thermistor devices ensure that current will continue to flow without increase or significant degradation in the series-wired circuit, regardless of what happens to particular lamps in the string.

Each thermistor device is protected from "current runaway" conditions, due to the current limiting effect of the remaining series connected lamps whose aggregate resistance values determine the magnitude of the current flowing through the string. If, for example, all of the lamps are removed from the string, the supply voltage of 120 volts (A.C.), or 170 volts (peak) appears across the 50 shunts. With each thermistor shunt effectively receiving one-fiftieth of the supply voltage or 2.4 volts, there is very little current conduction in the string because the load resistance is at least fifty times the resistance value of each of the thermistors used.

Figure 2:
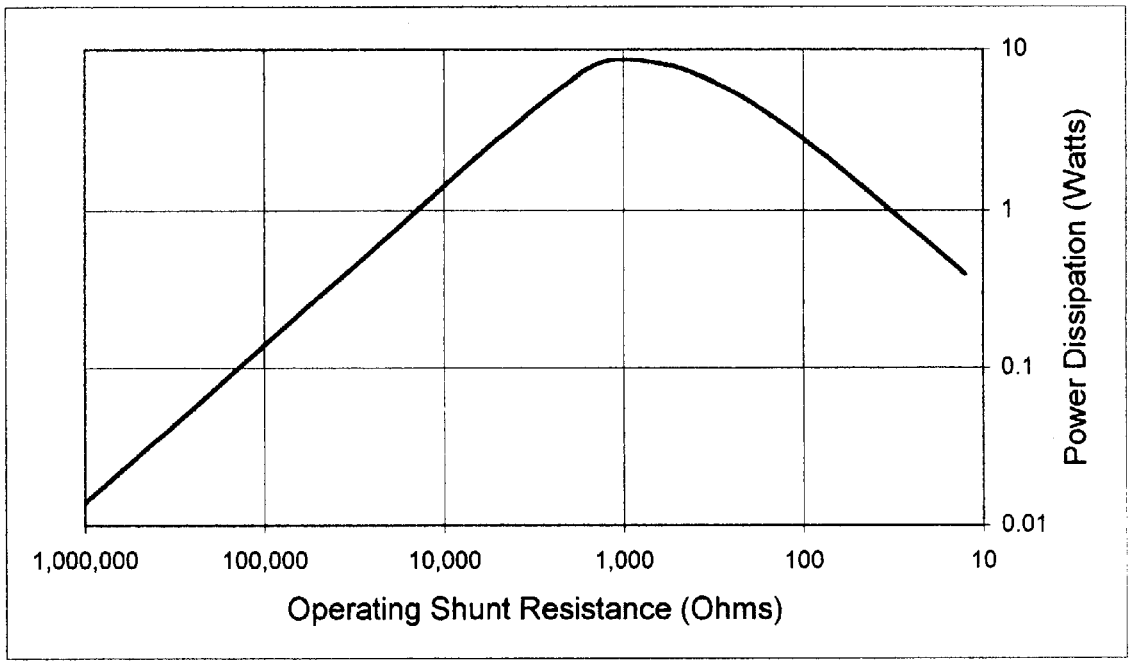
FIG. 2 is a chart showing the relation between power dissipation in a shunt device as a function of resistance of the device across a failed lamp, for a 50 light series light string, using 2.4 volt mini-lights and a 120 VAC power supply.
Figure 3:
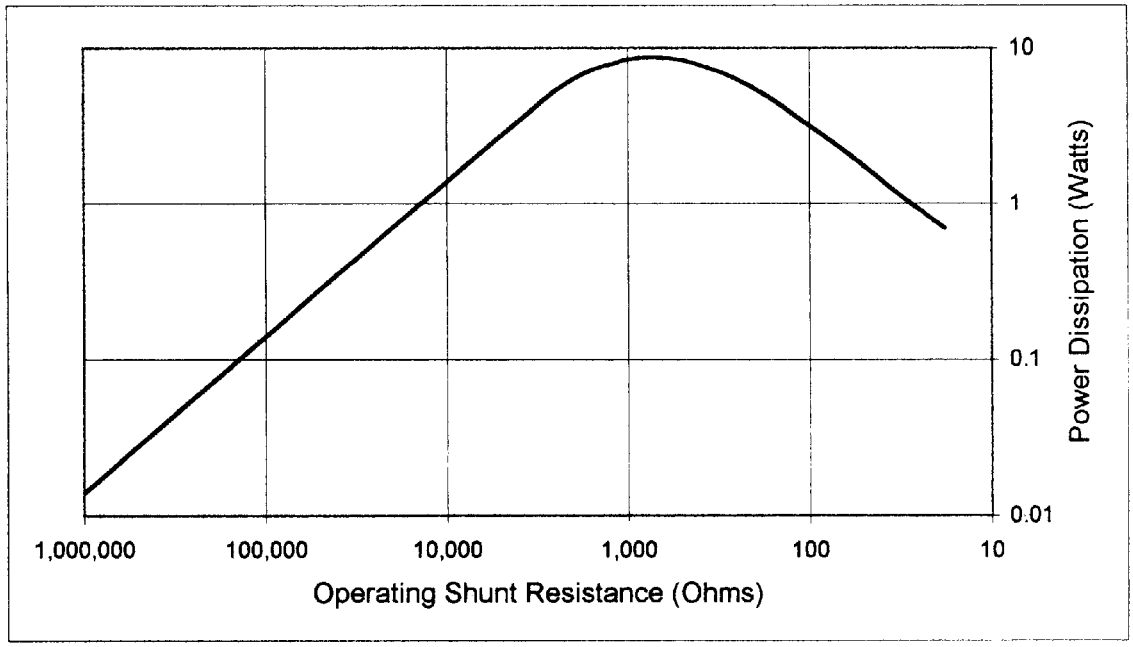
FIG. 3 is a chart showing the relation between power dissipation in a shunt device as a function of resistance of the device across a failed lamp, for a 35 light series light string, using 3.5 volt mini-lights and a 120 VAC power supply.

It is desirable to use at most, a base resistance that would allow initial operation at or near the point of maximum power dissipation by the device upon failure of its shunted lamp. Charts depicting the maximum power dissipation points in standard 2.4 and 3.5 volt, series mini-light strings are respectively shown in FIGS. 2 and 3. As can be seen, the curves shown in these charts are nearly the same. For example, base resistances of about 400–2200 ohms for use with 2.4–3.5 volt mini-lights in standard series light strings is presently preferred and would meet these criteria.

In experiments using NTC thermistor parts with higher base resistances, such as 3000 ohms, electrical failure of parts occurred. Melting of soldered joints was observed. A reason for this appears to be the fact that maximum power dissipation occurs relatively late in the resistance level transition after a lamp has failed, and it occurs at higher temperatures and endures for a longer time than with lower base resistance level parts. The power dissipation is the current through the shunt squared times the electrical resistance of the shunt. The problem is one of failure due to excess power dissipation as the shunt resistance is falling, which is greater for higher resistance shunts. Lower base resistance parts were not observed to present this problem.

It is also desirable that the base resistances be high enough to limit "leakage" current so there is no more than a 5% increase in string current compared to the same string without shunts. Consider a 50 light string operating at room temperature using 2.4-volt bulbs—each rated at 2.5 volts but actually illuminated at 120/50 (2.4) volts. A shunt resistance of 400 ohms, which is at the low end of the range stated, draws slightly more than 6 milliamperes when placed across a lamp illuminated at 2.4 volts. This is because the 2.4 volts applied to the thermistor would increase its temperature slightly lowering the thermistor resistance slightly and thus increasing the current correspondingly above 6 milliamperes. This is an approximately 3 to 5% increase in string current compared to a string if there were no shunts involved. The extra current is drawn by the shunt. A lesser value of thermistor resistance could be used with more current being drawn by the shunt resulting in unnecessary heating of the shunt and poorer electrical efficiency. On the high side of the range, stated at 2200 ohms, the shunt current is much less, but when activated, the response time could be unacceptable if operated in a cold environment such as outdoors on a cold winter day.

With shunt base resistances in the range of 400 to 2200 ohms, significant leakage current occurs when shunted across a lamp in a series connected string of lights. While one may argue this is undesirable (as prior art suggests), any resulting inefficiency has been found to be minor and outweighed by lower shunt response times in low voltage light strings and longer shunt life. Lower base resistance NTC thermistors generally transition to the proximity of a lamp's resistance level much more quickly than higher base resistance parts in shunts. Even where thermal time constants are the same, the percentage resistance change is less for lower base resistance NTC thermistors, and ballpark end resistance level is reached much earlier in the resistance transition cycle. The shunt operation response time is likely to be very important for commercial success of a light string. Especially with higher base resistance NTC thermistors, shunt response times increase significantly with falling ambient temperatures. Even with a NTC thermistor having a base resistance value of only 3000 ohms, the response time could be in tens of seconds when a low voltage light string is used on a cold winter day.

For a 50 light, 2.4-volt mini-light string, a 500-ohm NTC thermistor shunt may be used. Such a shunt would draw approximately 5 milliamperes at room temperature. In a cold environment, such as outdoors on a cold winter day, this current could drop to well below 1 milliampere. If used in a warm environment, the shunt current could be higher reaching approximately 10 milliamperes at 40° C. For a 35 light, 3.5-volt mini-light string, a 750 ohm NTC thermistor shunt may be used. Base resistance values within plus or minus twenty percent of these levels is presently preferred.

Because of today's electronics used in some light strings, such as flasher lamps and chaser light strings, to name just two, the shunt response times can become even more important. Flashing and twinkling lights, along with lights that come on slow and slowly dim, have intrigued consumers. The higher the NTC thermistor shunt's resistance when inactive, the slower the response time. The lower the NTC thermistor shunt's resistance when inactive, the more inefficient the string's operation becomes. It is a balance of these factors that can determine an ideal base resistance range for optimum performance of an NTC thermistor shunt.

Compared with other devices proposed for prior art light strings, NTC thermistors can provide an ideal and low cost shunt for low voltage lamps in a series-connected light string. Properly selected, NTC thermistors can be well suited for low voltage (e.g., Christmas mini-light) applications, for which an SMD (Surface Mount Device) thermistor form factor is presently preferred. For example, an SMD NTC thermistor may have a cylindrical or bar shaped profile and can be wedged into electrical contact with associated light string socket terminals.

EXAMPLE THERMISTOR

Applicable NTC type thermistor devices are well known and available with various impedance ratings. For example, one supplier is Mouser Electronics, Inc., 958 N. Main St., Mansfield, Tex. 76063-4827. In this example embodiment, Mouser Stock No. 334-31501 NTC 500 ohm thermistor devices were used. Other "parts off the shelf" included a 50 light string of series wired Christmas lights, which was a "Brite" set using bulbs rated at 2.5 volts, and 200 milliamperes. With 120 volts applied to the off the shelf string, the bulbs actually received 2.4 volts (average) and the string current was more like 187 milliamperes (typical). (Since the reported new UL current limit is 170 milliamperes, future strings may use different bulbs.)

The thermistors were added to every light string socket by connecting the thermistor leads in parallel to their associated lamp's terminals but actually in series in the line. The thermistors were of the NTC type (NTC=Negative Temperature Coefficient), each acting as a shunt to the associated bulb (or lamp), so that when the bulb was removed, the current continued through the string via the thermistor shunt. In normal operation, only a small amount of current flowed through the thermistor.

The light string bulbs each had a positive temperature coefficient of resistance while the thermistors in parallel with them had negative temperature coefficients. When voltage was first applied, each bulb's low resistance directed the bulk of the current through the bulb while the associated thermistor carried very little current. As a bulb's resistance increased, and it glowed, the thermistor was slightly warming and its resistance was lowering. The 500-ohm thermistors steadied out slightly less than 500 ohms each at room temperature when used as shunts in the 50 light string.

When a bulb was removed from a socket in the 50-light string of lights, the voltage drop across the associated thermistor shunt was measured to reach approximately four volts. At first, the voltage drop was quite high but as the thermistors' resistance decreased due to the string current through it, the voltage drop steadied to around four volts as indicated when the string was operated at room temperature. This four volts was approximately 1.6 volts higher than was dropped across the bulb socket when the bulb was operating normally. This means that the (49) remaining bulbs in the string each received slightly less voltage, thus, slightly reducing the light output of each remaining bulb. This lesser voltage amounted to 1.6/49 or approximately 33 millivolts less than normal voltage across each bulb.

In the case of the 35 light string using these 500-ohm parts, the voltage drops across the remaining bulbs stayed approximately the same after one bulb was removed. Using 750 ohm thermistors, the voltage was slightly higher after a bulb was removed.

Having described and illustrated the principles of my invention in presently preferred embodiments, it should be apparent that the invention may be otherwise embodied and implemented, and may incorporate such changes and modifications as may be applicable. For example, it should be quite apparent to those skilled in the art that a variety of temperature sensitive NTC devices could be used with equal success and that different resistance ratings could be used for different lamps in series strings. The scope of the invention is accordingly to be defined or limited only by issued claims.

What is claimed is:

1. A string set of series-connected incandescent lamps for use with particular rated values of electric operating potential and current, to illuminate the lamps in the string set by providing substantially the rated value of current flow through each of the lamps, wherein substantially all the lamps in the set are each provided with a respective heat sensitive shunt circuit comprising a negative temperature coefficient thermistor device having an electrical impedance dependent upon temperature in the thermistor device, where the temperature in the thermistor device is due at least in part to the ambient operating temperature and current flowing through the thermistor device, the thermistor device being connected in parallel with the associated lamp being shunted by the thermistor device, where the thermistor device has a base electrical resistance in the range of about 400 to 2200 ohms and presents an electrical resistance during normal operation of the string set twenty or more times the normal operating electrical resistance of the lamp being shunted by the thermistor device, so that leakage current through the thermistor device is substantially limited when the lamp being shunted by the thermistor device is operating normally in the string set, where the thermistor device changes to a relatively lower resistance state upon an increase in voltage across the thermistor device resulting from inoperativeness of the respective lamp being shunted, such as by reason of the lamp being shunted burning out, being put in its socket crooked or being loose in or missing from its socket, and where the thermistor device in the relatively lower resistance state has a voltage drop across the thermistor device equal to or greater than the value of the voltage drop across the associated lamp being shunted when the lamp is normally illuminated, whereby the voltage drop across each remaining illuminated lamp in the series-connected string set of lamps remains substantially unchanged with the continued flow of substantially the rated value of current flow through the string set and with substantially unchanged illumination by remaining operative string set lamps, despite the occurrence of a failure or loss of a lamp or removal of a lamp from its socket in the string set.

2. A string set of series-connected incandescent lamps for use with a particular value of operating potential to illuminate the string of lamps by providing substantially rated current flow through each of said lamps, wherein substantially all the lamps in the set are each provided with a respective heat sensitive shunt circuit consisting of a negative temperature coefficient thermistor device wherein the base electrical resistance is in the range of about 400 to 2200 ohms, and the electrical resistance is generally dependent upon temperature changes in the device due to current flowing through the device, which device presents an electrical resistance level during normal operation when shunted across a normally operating lamp and changes to a relatively lower electrical resistance state upon an increase in voltage across the device resulting from its respective lamp being inoperative or being loose or missing from its socket, said device in said relatively lower impedance state having a voltage drop equal to or greater than the value of the voltage drop across its respective lamp when illuminated, whereby the voltage drop across each illuminated lamp remains substantially unchanged with the continued flow of substantially said rated current flow through the light string and with substantially unchanged illumination by remaining operative string set lamps, despite the occurrence of a failed lamp or removal of a lamp from its socket in the string set.

3. An electric lamp assembly comprising an electric lamp shunted by a temperature sensitive NTC thermistor device connected in parallel with the lamp, in which the electric lamp is a 2.4–3.5 volt mini-light and the NTC thermistor device has a base resistance in the range of about 400 to 2200 ohms.

4. The electric lamp assembly of claim 3 in which the NTC thermistor device has at most a base resistance that would allow its initial operation at or near the point of maximum power dissipation by the NTC device upon failure of the electric lamp.

5. The electric lamp assembly of claim 4 in which the electric lamp is a 2.4 volt mini-light present in a fifty light series string, and in which the NTC thermistor device has a base resistance in the range of about 400 to 600 ohms.

6. The electric lamp assembly of claim 4 in which the electric lamp is a 3.5 volt mini-light present in a thirty-five light series string, and in which the NTC thermistor device has a base resistance in the range of about 600 to 900 ohms.

7. The electric lamp assembly of claim 4 in which the base resistance the NTC thermistor device is sufficiently high enough to limit "leakage" current through the device, so that there is no more than a 5% increase in total current through the device and the lamp, compared to the same lamp operating without the NTC device present.

8. The electric lamp assembly of claim 4 in which the base resistance of the NTC device is twenty or more times the resistance of the shunted lamp when the lamp is operating normally.

9. The electric lamp assembly of claim 8 in which the base resistance of the NTC device is less than one hundred eighty times the resistance of the shunted lamp when the lamp is operating normally.

10. A lighting apparatus comprising:

a string of lamps connected in series; and a heat sensitive shunt circuit connected in parallel with one of the lamps, said heat sensitive shunt circuit comprising a negative temperature coefficient thermistor device having an electrical impedance dependent upon temperature in the thermistor device.

11. The lighting apparatus of claim 10 wherein, when the one of the lamps is functioning normally, the thermistor device presents an electrical resistance at least twenty times a normal operating electrical resistance of the lamp and leakage current through the thermistor device is substantially limited.

12. The lighting apparatus of claim 11 wherein, when the one of the lamps is not functioning normally, the thermistor device changes to a relatively lower resistance state in response to an increase in temperature of the thermistor device.

13. The lighting apparatus of claim 12 wherein, when the thermistor device is operating in the relatively lower resistance state, a voltage drop across thermistor device is at least equal to a voltage drop across the lamp when the lamp is functioning normally.

14. The lighting apparatus of claim 13 wherein, when the thermistor device is operating in the relatively lower resistance state, the remaining lamps continue to substantially normally operate.

15. The lighting apparatus of claim 14 wherein the thermistor device has abase electrical resistance between about 400 ohms and 2200 ohms.

16. The lighting apparatus of claim 15 wherein the base electrical resistance of the thermistor allows the thermistor to operate initally at a substantially maximum power dissipation when the lamp is not functioning normally.

17. The lighting apparatus of claim 10 further comprising an additional number of heat sensitive shunt circuits, each of the additional number of shunt circuits connected in parallel with one of the lamps.

18. A lighting apparatus comprising:

a light socket comprising a lamp, a first terminal and a second terminal, the first terminal and the second terminal for supplying electrical current to the lamp; and a heat sensitive shunt circuit connected between the first terminal and the second terminal, said heat sensitive shunt circuit comprising a negative temperature coefficient thermistor device having an electrical impedance dependent upon temperature in the thermistor device.

19. The lighting apparatus of claim 18 wherein, when the lamp is functioning normally, the thermistor device presents an electrical resistance at least twenty times a normal operating electrical resistance of the lamp and leakage current through the thermistor device is substantially limited.

20. The lighting apparatus of claim 19 wherein, when the lamp is not functioning normally, the thermistor device changes to a relatively lower resistance state in response to an increase in temperature of the thermistor device.

* * * * *